US008465310B2

(12) United States Patent
Walls, Jr.

(10) Patent No.: US 8,465,310 B2
(45) Date of Patent: Jun. 18, 2013

(54) POWER CORD FOR ELECTRICAL DRYERS

(76) Inventor: Ferdinand Walls, Jr., Madera, CA (US)

( * ) Notice: Subject to any disclaimer, the term of this patent is extended or adjusted under 35 U.S.C. 154(b) by 0 days.

(21) Appl. No.: 12/770,703

(22) Filed: Apr. 29, 2010

(65) Prior Publication Data

US 2012/0220148 A1 Aug. 30, 2012

Related U.S. Application Data

(60) Provisional application No. 61/173,873, filed on Apr. 29, 2009.

(51) Int. Cl.
*H01R 27/00* (2006.01)

(52) U.S. Cl.
USPC ..... 439/218; 439/174

(58) Field of Classification Search
USPC ..... 439/172, 218, 221; 200/50 R, 51 R
See application file for complete search history.

(56) References Cited

U.S. PATENT DOCUMENTS

| | | | | |
|---|---|---|---|---|
| 3,034,000 | A * | 5/1962 | Todd | 307/156 |
| 4,856,999 | A * | 8/1989 | Flohr | 439/52 |
| 6,520,787 | B1 * | 2/2003 | Lott | 439/218 |
| 6,749,451 | B2 * | 6/2004 | Schmitt | 439/218 |
| 6,780,034 | B2 * | 8/2004 | Shiroshita et al. | 439/174 |

* cited by examiner

*Primary Examiner* — Khiem Nguyen
(74) *Attorney, Agent, or Firm* — Richard A. Ryan

(57) ABSTRACT

A power cord for use with an electric dryer and outlet to electrically connect the dryer to an electrical receptacle of the outlet having a plurality of prong-receiving openings that are configured in either a first opening pattern or a second opening pattern. In the preferred embodiment, the power cord comprises a plug having a first side with a plurality of first plug prongs extending outwardly therefrom and a second side with a plurality of second plug prongs extending outwardly therefrom. The first plug prongs are in a first prong pattern that corresponds with the first opening pattern and the second plug prongs are in a second prong pattern that corresponds with the second opening pattern. The user utilizes the appropriate side of the plug to electrically connect the dryer to the receptacle. A switch on the plug allows the user select which side is electrically activated.

6 Claims, 3 Drawing Sheets

POWER CORD FOR ELECTRICAL DRYERS

CROSS-REFERENCE TO RELATED APPLICATIONS

This patent application claims priority to U.S. Provisional Patent Application No. 61/173,873 filed Apr. 29, 2009.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to power cords for electrically connecting an object to an electrical outlet. In particular, the present invention relates to such power cords that are utilized to electrically connect an electric dryer to an electrical outlet. Even more particularly, this invention relates to such power cords which can selectively connect to an electrical outlet having a receptacle with either a four-prong or three-prong configuration.

B. Background

For many years, a large percentage of the population in the United States has primarily used electrically powered dryers for drying clothes, bedding, shoes and other materials. A power cord connects the electric dryer to a source of electrical power, which is typically a wall mounted electrical outlet. Because of the higher electrical load requirements, electric dryers have historically utilized a power cord having a specially configured three-prong plug that is received into a cooperatively configured three-prong receptacle. As a result, most older homes were built with an electrical outlet having a three-prong receptacle in the area where the electric dryer was placed. Since approximately 1996, however, nearly all municipal electrical codes require four-prong receptacles at the electrical outlet to which the dryer connects and use of a cooperatively configured four-prong plug for the electric dryer power cord. In addition to the black and red power wires and the white neutral wire, the four-prong power cord has a green ground wire that does not carry any current. Instead, the green ground wire is grounded back to the junction box or to a separate ground. Inside the dryer, the white neutral wire is not bonded to the chassis and the green wire is grounded from the wiring terminals.

Most homes built prior to 1996 have the three-prong receptacle for the electric dryer, which will not work with the four-prong plugs that are required for newer dryers. Because so many older homes have a three-prong receptacle, most municipal codes allow the dryer to be rewired for use with a power cord that has a three-prong plug. Rewiring the electric dryer involves disconnecting the separate ground strap and connecting it to the neutral white wire, which in effect reverts the dryer wiring arrangement to the pre-1996 configuration. As a result, most dryer manufactures configure their dryers to work with either a three-prong or a four-prong power cord. Typically, this requires the manufacturer or retailer to deliver the dryer to the home with both of these power cords and then rewire the dryer at the purchaser's home for use with either a three-prong receptacle or a four-prong receptacle, depending which is utilized in the home. Having to provide two power cords increases the cost of the dryer, increases inventory issues with regard to keeping both types of power cords in stock and increases the time and cost to deliver and set-up the dryer. Although the home itself could be rewired to replace an existing three-prong receptacle with a four-prong receptacle, most homeowners do not want to incur the expense for such rewiring.

What is needed, therefore, is an improved power cord that allows the user to electrically connect an electric dryer to an outlet having a receptacle with either four prong-receiving openings or three prong-receiving openings. The preferred power cord should be configured to allow a user to quickly and without any rewiring of the dryer or the outlet selectively connect the power cord to either a four-prong opening receptacle or a three-prong opening receptacle, whichever is already present at the home or other place of delivery. The power cord should be configured to safely interconnect the dryer to the outlet so the user will not be exposed to the risk of an electrical shock.

SUMMARY OF THE INVENTION

The power cord for electrical dryers of the present invention provides the benefits and solves the problems identified above. That is to say, the present invention discloses a power cord that allows the user to easily, quickly and safely connect an electric dryer to an electrical outlet that has a receptacle which is configured with either four prong-receiving openings or three prong-receiving openings. The power cord of the present invention does not require any rewiring of the dryer or the outlet in order for the user to selectively connect an electric dryer to an existing outlet having a receptacle with either four prong-receiving openings or three prong-receiving openings.

In one embodiment of the present invention, the power cord is utilized in combination with an outlet having an electrical receptacle comprising a plurality of prong-receiving openings that are disposed in either a first opening pattern or in a second opening pattern to electrically connect an electric dryer to the outlet receptacle. The preferred power cord comprises a plug disposed at the end of a plug wire, with the plug having a plug body with a first side defining a first side surface and a second side defining a second side surface. In a preferred embodiment, each of the first and second side surfaces are generally planar. The first side has one or more first plug prongs that are configured in a first prong pattern which is in corresponding relationship with the first opening pattern and the second side has one or more second plug prongs that are configured in a second prong pattern which is in corresponding relationship with the second opening pattern. In a preferred configuration, the first side has four plug prongs and the second side has three plug prongs so that the power cord may be used with both the modern receptacles having four prong-receiving openings and the older receptacles having three prong-receiving openings. Typically, the first and second plug prongs will extend outward from their respective side surfaces in generally opposite directions to better engage the prong-receiving openings of the receptacle. In the preferred embodiment, the power cord has a switch on the plug body or another type of switching mechanism associated with the plug to allow the user to electrically engage and activate one of the first plug prongs and the second plug prongs. The preferred embodiment also comprises a first cap having a cap face with one or more prong-receiving openings that are disposed in corresponding relation to the first prong pattern and a second cap having a cap face with one or more prong-receiving openings disposed in corresponding relation to the second prong pattern so the prongs of the power cord can be completely covered when not in use. In an alternative embodiment, a single cap can be provided that is configured to cover only the exposed, non-used prongs when the opposite side prongs are engaged with the outlet receptacle to provide electric power to the electric dryer.

Accordingly, the primary aspect of the present invention is to provide a power cord to electrically connect an electric dryer to an outlet receptacle that provides the benefits described above and solves the problems associated with presently available power cords for connecting an electric dryer to an electrical outlet receptacle.

It is an important aspect of the present invention to provide a power cord that allows the user to connect an electric dryer to an outlet receptacle that has either four prong-receiving openings or three prong-receiving openings without having to change the power cord or the receptacle.

It is also an important aspect of the present invention to provide a single universal power cord that can be utilized with both types of presently available outlet receptacles that are used to provide electric power to an electric dryer.

Another important aspect of the present invention is to provide a power cord that allows the user to easily and quickly move an electric dryer between an outlet receptacle having four prong-receiving openings and an outlet receptacle having three prong-receiving openings.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The accompanying figures are merely illustrative of one or more of the preferred embodiments and, as such, represent one or more ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are directed to a specific type of switch mechanism to allow the user to select which connection is to be utilized, those who are skilled in the art will readily understand that this is merely for purposes of simplifying the present disclosure and that the present invention is not so limited.

Figure 1:
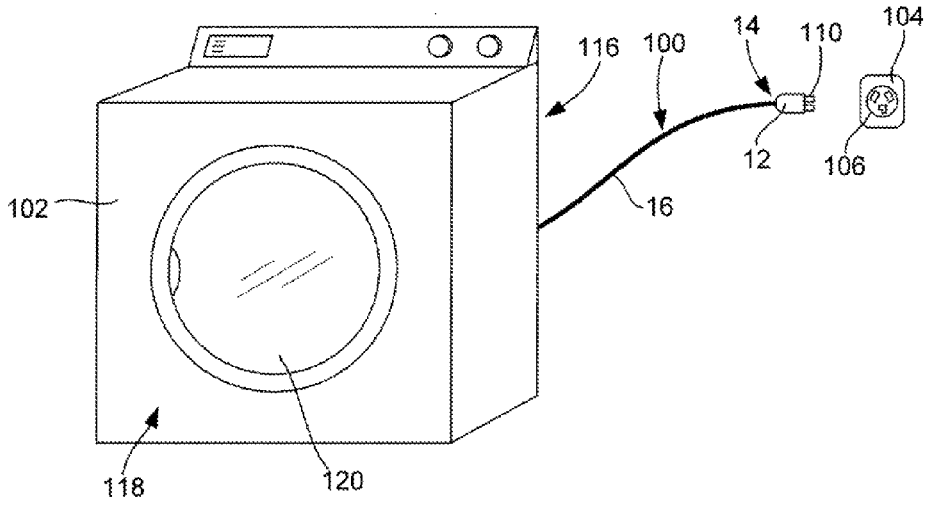
FIG. 1 (PRIOR ART)
FIG. 1 is a perspective view of an electric dryer having a prior art power cord for electrically connecting the dryer to an outlet.
Figure 2:
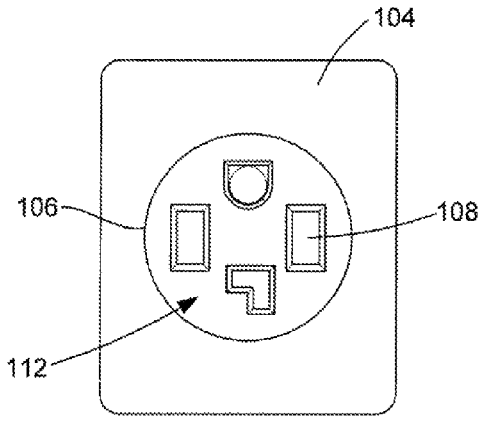
FIG. 2 (PRIOR ART)
FIG. 2 is a front view of an outlet having four prong-receiving openings disposed in a first opening pattern.
Figure 3:
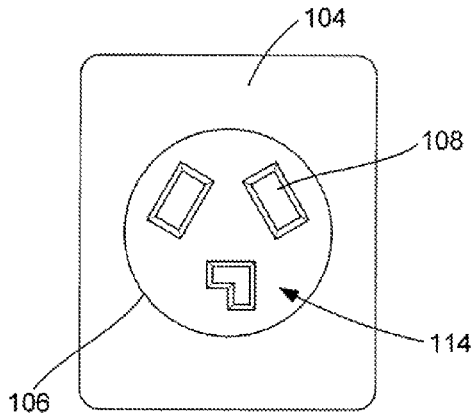
FIG. 3 (PRIOR ART)
FIG. 3 is a front view of an outlet having three prong-receiving openings disposed in a second opening pattern.

A power cord that is configured pursuant to a preferred embodiment of the present invention is shown generally as 10 in FIGS. 1 and 4 through 8. As shown in FIG. 1, a prior art power cord 100 has a plug 12 that is disposed at the distal end 14 of a plug wire 16, which extends outwardly from an electric dryer 102, to electrically connect the dryer 102 to a specially configured dyer electrical outlet 104 having a receptacle 106. As best shown in FIGS. 2 and 3, receptacle 106 of outlet 104 has a plurality of prong-receiving openings 108 that are each sized and configured to receive one prong, shown collectively as 110 in FIG. 1, that extends outwardly from the plug 12 of power cord 100. As set forth in the Background, the typical pre-1996 dryer outlet 104 has a receptacle 106 with three prong-receiving openings 108, as shown in FIGS. 1 and 3, and the typical 1996 or later dryer outlet 104 has a receptacle 106 with four prong-receiving openings 108, as shown in FIG. 2. The prong-receiving openings 108 of either receptacle 106 are disposed in a pattern that is configured in corresponding relation to the pattern of the prongs 110 of the plug 12. For purposes of the disclosure of the present invention, the opening pattern having four prong-receiving openings 108 is referred to herein as the first opening pattern 112 and the opening pattern having three prong-receiving openings 108 is referred to herein as the second opening pattern 114, as shown in FIGS. 2 and 3. Although the opening patterns 112/114 shown in the figures are typical for prior art power cords 100 used with presently available electric dryers 102, those persons skilled in the art will readily understand that other configurations of the opening patterns 112/114 of the receptacle 106 may also exist.

As well known in the art, the plug wire 16 typically extends from the back end 116 of the electric dryer 102, with the front end 118 being the end that typically has a door 120 through which clothes and other articles to be dried are inserted into the rotating drum of dryer 102. In FIG. 1, the prior art power cord 100 of electric dryer 102 is shown connecting to a receptacle 106 having three prong-receiving openings disposed in the second opening pattern 114. As also well known in the art, the pattern of the prongs 110 on plug 12 of the prior art power cord 100 will be configured to match one, and only one, of either the first opening pattern 112 or the second opening pattern 114 so power cord 100 can be electrically connected to the outlet 104. Such a power cord 100 cannot be utilized with an outlet 104 having a receptacle 106 with a non-matching opening pattern 112/114.

As set forth in the Background, the prior art power cord 100 has to be installed on dryer 102 when it is delivered so the pattern of the prongs 110 on plug 12 will match the existing first 112 or second 114 opening pattern of the receptacle 106 of the house or other location where the dryer will be utilized and the dryer 102 has to be rewired for the appropriate power cord 100. Alternatively, the outlet 104 must be replaced/rewired. Once the power cord 100 of dryer 102 is configured for a particular opening pattern 112/114, if the user moves the dryer 102 to a location having an outlet 104 with a receptacle 106 that has a different opening pattern 112/114, then he or she must have the power cord 100 replaced and the dryer 102 rewired to match the opening pattern 112/114 of the new receptacle 106 or change the configuration of the receptacle 106 of outlet 104, either of which will take time and cost money. As set forth in more detail below, the power cord 10 of the present invention solves this problem.

Figure 4:
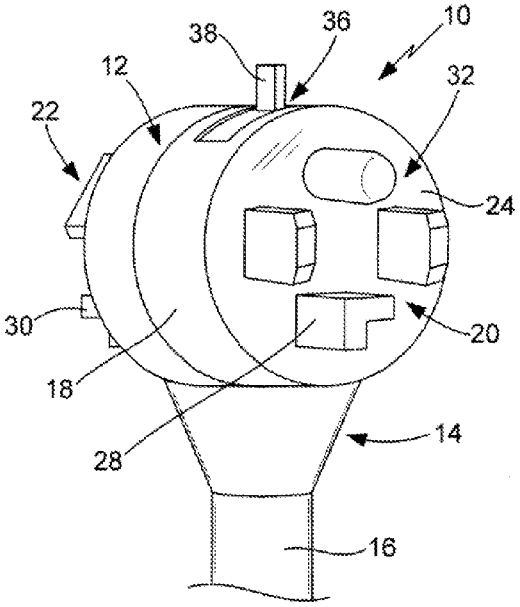
FIG. 4 is a perspective view of the first side of a plug at the distal end of a power cord configured according to the present invention showing four prongs extending outward from the plug that are configured in corresponding relation to the first opening pattern.
Figure 5:
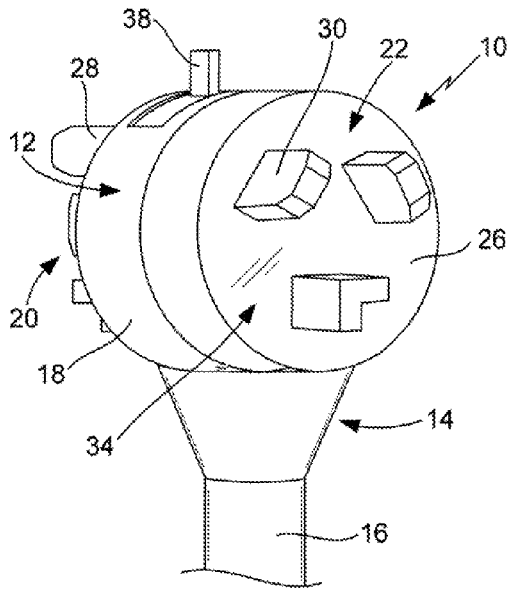
FIG. 5 is a perspective view of the second side of the plug of the power cord of FIG. 4 showing three prongs extending outward from the plug that are configured in corresponding relation to the second opening pattern.
Figure 6:
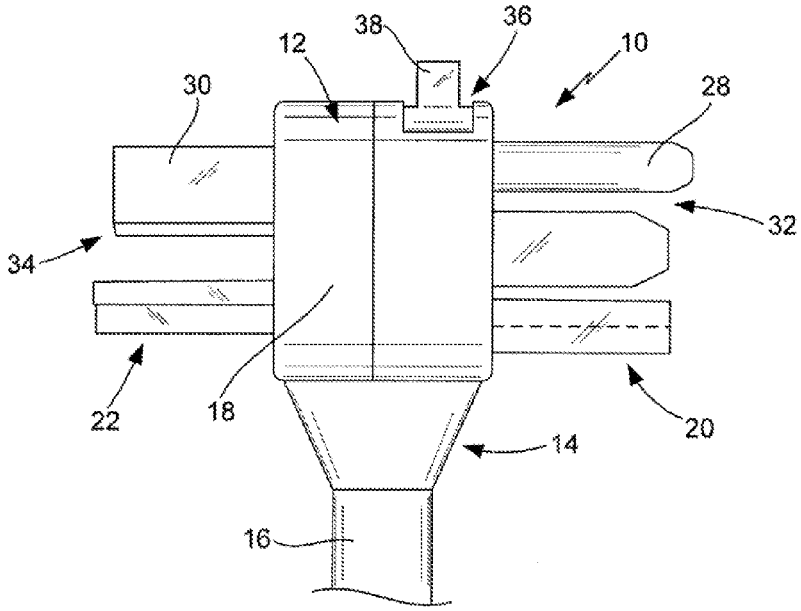
FIG. 6 is an end view of the plug at the distal end of the power cord of FIG. 4 showing the four prongs on the right side thereof and three prongs on the left side thereof.
Figure 7:
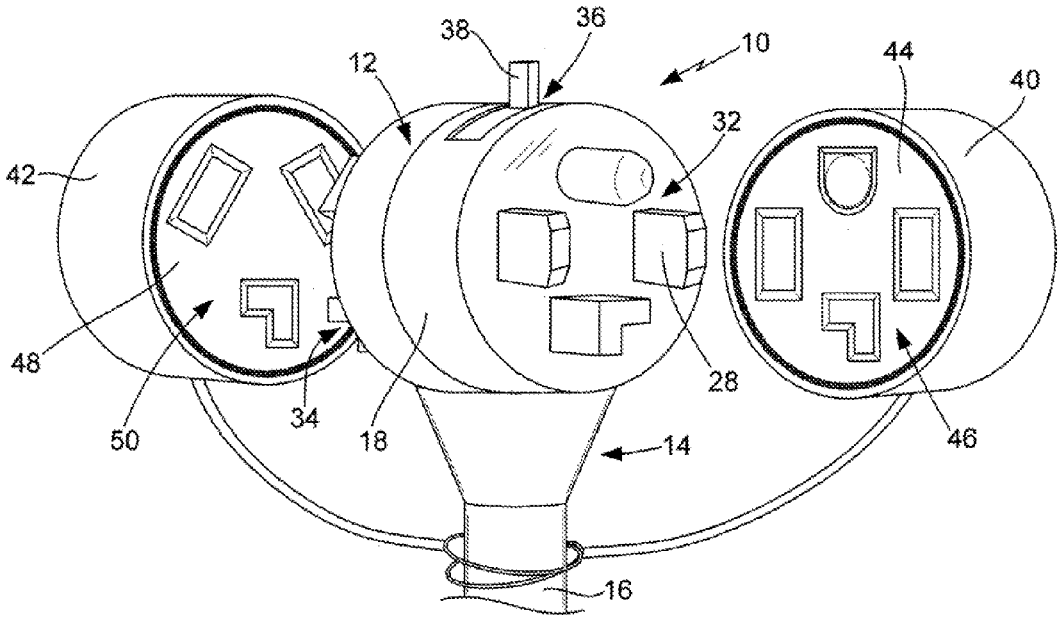
FIG. 7 is a perspective view of the first side of the plug of the power cord of FIG. 4 having plug caps configured to cover the prongs of the plug with the plug caps shown disengaged from the prongs.
Figure 8:
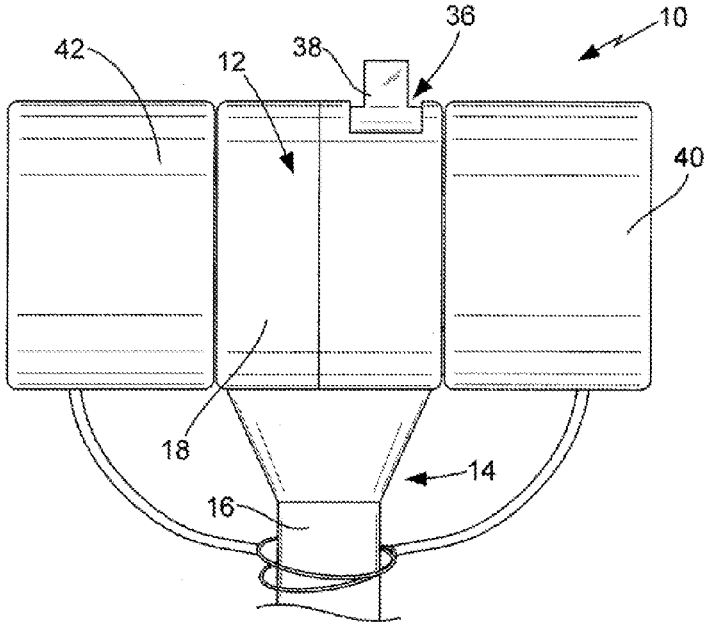
FIG. 8 is an end view of the plug of the power cord of FIG. 7 showing the plug caps attached to the prongs.

The power cord 10 of the preferred embodiment of the present invention has plug 12 disposed at the distal end 14 of plug wire 16 to electrically connect a dryer 102 to an electrical outlet 104 having a receptacle 106 with a plurality of prong-receiving openings 108. As shown in FIGS. 4 through 8, the plug 12 of the power cord 10 of the present invention comprises a plug body 18 having a first side 20 and a second side 22. In the preferred embodiment, the first side 20 has a generally planar first side surface 24 and the second side 22 has a generally planar second side surface 26 and the first side surface 24 faces in a direction that is generally opposite that of the second side surface 26, as best shown in FIG. 6. FIG. 4 is a perspective view of the first side 20 and FIG. 5 is a perspective view of the second side 22 of the plug body 18 of plug 12. In the preferred embodiment, plug body 18 is made out of a non-conductive material, such as plastic or other polymers, rubber or other elastomers, and a variety of other non-conductive materials, as well known in the art for plugs used with electric power cords. As will also be readily understood by those skilled in the art, the plug body 18 has appropriately configured internal wiring that allows the user to configure power cord 10 to selectively transmit electricity from either the first side 20 or the second side 22 of plug 12 to the dryer 102 through the plug wire 16, as set forth in more detail below.

As set forth above, the outlet 104 to which dryer 102 will connect via power cord 10 has a receptacle 106 with a plurality of prong-receiving openings 108, typically either three or four openings, that are disposed in the first 112 or second 114 opening pattern, with the opening pattern being generally defined as the number and configuration (including positioning, size and shape) of the prong-receiving openings 108 in the receptacle 106. For purposes of simplifying the disclosure of the present invention, the power cord 10 is described as being suitable for use with an outlet 104 having a receptacle 106 with either four prong-receiving openings 108 in the first opening pattern 112 or three prong-receiving openings in the second opening pattern 114, which are typical opening patterns 112/114 for dryers 102 sold and used in the United States. As will be readily apparent to those skilled in the art, however, the power cord 10 of the present invention is not so limited. The power cord 10 may be configured for use with outlets 104 having receptacles 106 with virtually any number of prong-receiving openings 108 and with the openings 108 in any position and having any configuration.

In the embodiment shown in the drawings, the power cord 10 has a plug 12 with four first plug prongs 28 that extend outwardly from the first side surface 24 of first side 20, as best shown in FIGS. 4 and 6, and three second plug prongs 30 that extend outwardly from the second side surface 26 of second side 22, as best shown in FIGS. 2 and 3. In the figures, the first plug prongs 28 and the second plug prongs 30 extend generally straight outward from their respective side surfaces 24/26. Those persons skilled in the art will understand that in some embodiments, the first 28 and/or second 30 plug prongs may not extend straight outward from their respective side surfaces 24/26. The first plug prongs 28 are configured in a first prong pattern 32 which is in corresponding relationship with the first opening pattern 112 of an outlet 104 having a receptacle 106 with four prong-receiving openings 108 and the second plug prongs 30 are configured in a second prong pattern 34 that is in corresponding relationship with the second opening pattern 114 of an outlet 104 having a receptacle 106 with three prong-receiving openings 108. Typically, the first plug prongs 28 of the first prong pattern 32 will correspond in number, size, shape and positioning (as well as any other factors) with the prong-receiving openings 108 of the first opening pattern 112 such that the first plug prongs 28 can be fully received in their respective prong-receiving openings 108 to electrically connect with the electrical receptacle 106 of outlet 104. Likewise, the second plug prongs 30 of the second prong pattern 34 will typically correspond in number, size, shape and positioning (as well as any other factors) with the prong-receiving openings 108 of the second opening pattern 114 such that the second plug prongs 30 can be fully received in their respective prong-receiving openings 108 to electrically connect with the electrical receptacle 106 of outlet 104. As will be readily understood by those skilled in the art, it is sufficient that the corresponding relationship between the first prong pattern 32 and first opening pattern 112 and the corresponding relationship between the second prong pattern 34 and the second opening pattern 114 allow the necessary physical and electrical connection between the plug 12 and receptacle 106. In some configurations, the size and shape of the plug prongs 28/30 may not be exactly the same as the size and shape of the prong-receiving openings 108, but still provide the desired physical and electrical connection. The first plug prongs 28 and the second plug prongs 30 of plug 12 may be made out of copper, brass or other electrically conductive material, which materials are generally well known in the art, so as to transmit electricity from the outlet 104 to the dryer 102 through power cord 10.

In the preferred embodiment of the present invention, power cord 10 comprises a switching means 36 on plug 12 that is operatively configured for switching between the first plug prongs 28 on the first side 20 and the second plug prongs 30 on the second side 22 of plug 12. In a preferred configuration, the switching means 36 comprises an outwardly extending switch 38, as shown in FIGS. 4-8. The switching means 36 is connected to the wiring inside plug 12 and configured to allow the user to selectively choose whether to electrically activate the first plug prongs 28 or the second plug prongs 30 as required to match the pattern of the receptacle 106 of the outlet 104 to which the power cord 10 will connect. When one side, either the first side 20 or second side 22, is electrically activated, the other side is not energized, thereby reducing the risk of injury to a person who may accidently contact the side of the plug 12 which is extending outwardly from the outlet 104. In the preferred embodiment, the switching means 36 can be reversed at any time to switch between the first side 20 or the second side 22 to allow the user to move dryer 102 to a new location that has an outlet 104 with a differently configured receptacle 106. In an alternative embodiment, the switching means 36 can be configured for a single selection to activate either the first side 20 or the second side 22 that leaves the plug 12 configured for only that type of receptacle 106 having prong-receiving openings 108 that match the original selection. Although this makes the power cord 10 and the dryer 102 less versatile after the selection, it may have benefits with regard to safety or related issues. In addition, or alternatively, the switching means 36 can be of the type that has a switch 38 which is not easily moved from one position to another in order to prevent accidental activation of the non-use side 20/22 of plug 12 which could cause injury or death to a person who were to contact the "non-use" prongs 110 on plug 12.

The preferred configuration of power cord 10 also comprises a first cap 40 that is configured to be placed on and engage the first plug prongs 28 and a second cap 42 that is configured to be placed on and engage the second plug prongs 30, as shown in FIGS. 4 and 5. When one or more of the plug prongs 28/30 on first side 20 and second side 22, respectively, are not in use, the first cap 40 and/or the second cap 42 can be placed on their respective plug prongs 28/30 to protect the plug prongs 28/30 from damage. As shown in FIG. 4, the first cap 40 has a cap face 44 that contains a set of first prong-receiving openings 46 that are in corresponding relation to the first prong pattern 32 of the first plug prongs 28 and the second cap 42 has a cap face 48 that contains a set of second prong-receiving openings 50 that are in corresponding relation to the second prong pattern 34 of the second plug prongs 30. Typically, the prong-receiving openings 46 of the first cap 40 will correspond to the first opening pattern 112 of receptacle 106 and the prong-receiving openings 50 of the second cap 42 will correspond to the second opening pattern 114 of receptacle 106 to obtain the desired tight fit between the caps 40/42 and plug 12. FIG. 5 shows the first cap 40 and the second cap 42 mounted on their respective sides 20/22 of plug 12 to protect the prongs 110 thereof when power cord 10 is not in use.

Utilizing power cord 10, a dryer 102 is fitted with power cord 10 at the factory by the manufacturer and then delivered, typically from a retailer or the like, to a home or other location of use without the need to include alternative power cords. This will save on the cost of providing the correct power cord and reduce the time, hassle and inventory issues associated with providing an appropriately configured dryer power cord. Instead of having to determine which type of outlet 104 the buyer has or sending two sets of power cords that the installer has to select from in order to install the dryer 102, the retailer will send out the dryer 102 with power cord 10 pre-installed. Once at the location where the dryer 102 will be utilized, the installer or the user himself/herself merely has to operate the switching means 36, typically by moving switch 38 to the appropriate location, to electrically connect the plug wire 16 from the dryer 102 to the plug prongs 28/30 on the first 20 or second 22 side of plug 12 and then insert the appropriate plug prongs 28/30 into the receptacle 106 at the outlet 104 where electricity is desired for the dryer 102. If the dryer 102 is moved to a different use location or the outlet 104 is changed to a different prong-receiving configuration, the user can utilize the same power cord 10 by merely operating the switching means 36 to activate the other side 20/22 of the plug 12. No removal of the power cord 10 or re-wiring of the outlet 104 is required.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A power cord electrically connected to a dryer, said power cord utilized in combination with an electrical receptacle having a plurality of prong-receiving openings disposed in one of a first opening pattern with four of said prong-receiving openings and a second opening pattern with three of said prong-receiving openings to electrically connect the dryer to said receptacle, said power cord comprising:

a plug at a distal end of said power cord, said plug having a plug body with a first side defining a first side surface and a second side defining a second side surface;

four first plug prongs extending outwardly from said first side surface of said first side of said plug body, said first plug prongs configured in a first prong pattern that is in corresponding relationship with said first opening pattern; and three second plug prongs extending outwardly from said second side surface of said second side of said plug body, said second plug prongs configured in a second prong pattern that is in corresponding relationship with said second opening pattern.

2. The power cord of claim 1, further comprising a switch on said plug body that is electrically connected to each of said first plug prongs and said second plug prongs to allow a user to electrically engage one of said first plug prongs and said second plug prongs with said receptacle.

3. The power cord of claim 1, wherein said first plug prongs at said first side and said second plug prongs at said second side are disposed in generally opposite directions.

4. A power cord electrically connected to a dryer, said power cord utilized in combination with an electrical receptacle having a plurality of prong-receiving openings disposed in one of a first opening pattern with four of said prong-receiving openings and a second opening pattern with three of said prong-receiving openings, said power cord comprising:

a plug at a distal end of said power cord, said plug having a plug body with a first side defining a first side surface and a second side defining a second side surface;

four first plug prongs extending generally outward from said first side surface, said first plug prongs configured in a first prong pattern that is in corresponding relationship with said first opening pattern;

three second plug prongs extending generally outward from said second side surface, said second plug prongs configured in a second prong pattern that is in corresponding relationship with said second opening pattern, said second plug prongs disposed in generally opposite direction from said first plug prongs; and a switch on said plug body between said first side and said second side thereof, said switch electrically connected to each of said first plug prongs and said second plug prongs to allow a user to electrically engage one of said first plug prongs and said second plug prongs with said receptacle so as to electrically connect the dryer to said receptacle.

5. A power cord utilized in combination with an outlet having a receptacle with a plurality of prong-receiving openings disposed in one of a first opening pattern with four of said prong-receiving openings and a second opening pattern with three of said prong-receiving, said power cord comprising:

a plug having a plug body with a first side defining a first side surface and a second side defining a second side surface;

four first plug prongs extending outward from said first side surface in a first prong pattern disposed in corresponding relation with said first opening pattern; and three second plug prongs extending outward from said second side surface in a second prong pattern disposed in corresponding relation with said second opening pattern, wherein said second plug prongs are disposed in generally opposite direction from said first plug prongs, said power cord electrically connected to a dryer and one of said first plug prongs and said second plug prongs on said plug body are utilized to connect said power cord to said receptacle so as to electrically connect said dryer to said receptacle.

6. The power cord of claim 5, further comprising a switch on said plug body that is electrically connected to each of said first plug prongs and said second plug prongs to allow a user to electrically engage one of said first plug prongs and said second plug prongs with said receptacle.

* * * * *